US005390400A

United States Patent [19]

Jacob et al.

[11] Patent Number: 5,390,400

[45] Date of Patent: Feb. 21, 1995

[54] PROCESS FOR HEAT TREATING MOVING YARNS AND APPARATUS THEREFOR

[75] Inventors: Ingolf Jacob, Untermeitingen; Josef Geirhos, Bobingen, both of Germany

[73] Assignee: Hoechst Aktiengesellschaft

[21] Appl. No.: 90,326

[22] Filed: Jul. 12, 1993

[30] Foreign Application Priority Data

Jul. 10, 1992 [DE] Germany ..... 42 22 721.6

[51] Int. Cl.[6] ..... D02J 13/00

[52] U.S. Cl. ..... 28/274; 34/422; 34/629; 28/219; 28/220

[58] Field of Search ..... 28/220, 247, 249, 288, 28/274; 34/23, 26, 28, 30, 48, 148, 151, 152, 155, 160, 218, 227, 232; 264/211.17, 211.2; 428/370; 425/71

[56] References Cited

U.S. PATENT DOCUMENTS

| | | | |
|---|---|---|---|
| 3,368,335 | 2/1968 | Horvath | 34/152 X |
| 3,606,689 | 9/1971 | Matsuo et al. | 34/155 |
| 3,694,872 | 10/1972 | Sundbeck | 28/71.3 |
| 3,724,038 | 4/1973 | Chimura et al. | 28/1.2 |
| 3,824,778 | 7/1974 | Flanders, Jr. | 57/157 TS |
| 4,206,552 | 6/1980 | Pomerantz et al. | 34/23 |
| 4,529,378 | 7/1985 | Runkel et al. | 432/59 |
| 4,549,361 | 10/1985 | Brough et al. | 34/17 |
| 4,565,524 | 1/1986 | Runkel et al. | 34/160 X |
| 4,680,872 | 7/1987 | Bauer | 34/23 |
| 4,753,777 | 6/1988 | Yoshimari et al. | 34/155 X |
| 4,785,552 | 11/1988 | Best | 34/30 |
| 5,100,729 | 3/1992 | Jacob et al. | 428/370 |
| 5,197,202 | 3/1993 | Jensen | 34/155 X |

FOREIGN PATENT DOCUMENTS

| | | |
|---|---|---|
| 0897400 | 4/1972 | Canada . |
| 1364515 | 5/1964 | France . |
| 0967805 | 12/1957 | Germany . |
| 1660314 | 4/1972 | Germany . |
| 2927032 | 10/1983 | Germany . |
| 8312985 | 11/1983 | Germany . |
| 7018370 | 7/1953 | Netherlands . |
| 1216519 | 12/1970 | United Kingdom . |

*Primary Examiner*—John J. Calvert
*Attorney, Agent, or Firm*—Connolly & Hutz

[57] ABSTRACT

A gentle and fast process for heating yarns passing contactlessly through a heating apparatus. The process includes the steps of preheating a heat transfer has to a temperature above the desired final yarn temperature, feeding the preheated heat transfer gas to the yarn duct so that it impinges essentially perpendicularly on the moving yarn and along a length such that the yarn heats up to the desired elevated temperature within the heating apparatus. The present invention may be used for heating air jet textured yarns and for setting two component loops sewing yarns. The invention further relates to an apparatus for carrying out the process including a preheating means, a duct in the form of a tube drilled with holes, feed lines, and a distributor chamber enabling the heat transfer gas to impinge radially upon the outside of the yarn moving contactlessly in the duct.

23 Claims, 2 Drawing Sheets

PROCESS FOR HEAT TREATING MOVING YARNS AND APPARATUS THEREFOR

Figure 1:
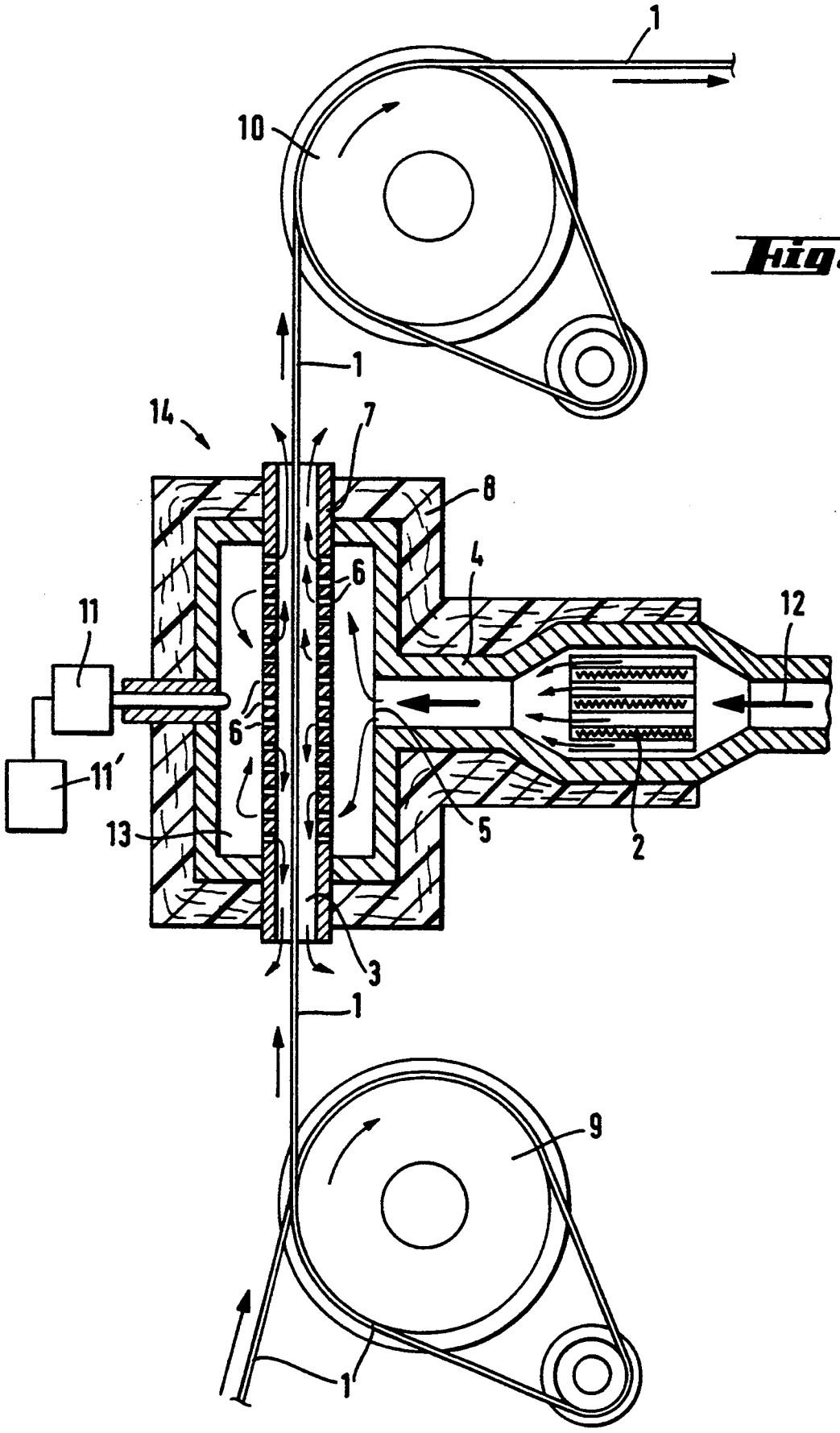

The present invention relates to a novel process whereby fast moving yarns can be heated rapidly, gently and uniformly across the cross-section to a desired elevated temperature, and to particularly adapted apparatus for carrying out the process.

Heating plays a large part in the art of yarn making and processing; accordingly, a large number of heating processes and apparatuses are known.

These processes and apparatuses can be classified for example according to the manner of heat supply. For instance, it is customary to supply the heat by means of heat transfer media, for example hot liquids or gases, by contact with the yarn. It is also customary to transfer the heat from hot surfaces by radiation therefrom or contact therewith.

Similarly, a number of processing operations on fast moving yarns, for example drawing or setting, necessitate heating. It is common knowledge that in these operations the heat should be supplied as rapidly and gently as possible.

The rate of heat transfer is known to depend fundamentally on the temperature gradient between the heat supply and the object to be heated. To maximize the rate of heat transmission, it is common rouse the highest possible temperature for the heating medium. However, an excessively high temperature causes overheating of parts of the yarn bundle, such as protruding individual filaments or loops. There is therefore a conflict between the demands for the very rapid yet also gentle treatment.

DE-A-1,660,314 discloses a process for continuously heating tows wherein the tow floats without any contact with a support and completely free of tension on a gas stream acting as a cushion. Nowhere in this reference is there any suggestion of the treatment of yarns, i.e. structures having a lower linear density.

EP-A-114,298 discloses a heating chamber for moving yarns wherein the yarns are treated with saturated steam at more than 2 bar. The heating chamber is characterized by a special form of seal for the yarn inlet and outlet, which gives a good sealing effect, allows simple threading, and makes possible rapid attainment of the operational state after threading. According to the description, heat transfer takes the form in particular of condensation of the saturated steam on the yarn in the heating chamber, thereby ensuring a high uniformity of the treatment temperature. The yarn leaving the heating chamber thus generally contains condensed water, which evaporates again in the subsequent operations. The treatment temperature in this heating chamber is not readily variable, since it corresponds to the temperature of the saturated steam.

EP-A-193,891 discloses a heating means for a crimping machine. Said heating means comprises an upright or inclined yarn guide tube which is heated at its outer surface. To improve the heat transmission to the moving yarn, the yarn inlet side of the yarn guide tube is fitted with an air nozzle through which fresh air is blown into the yarn tube. This device is intended to make the heat treatment more effective. The actual heating of the fresh air takes place only in the heating means itself. This heating means cannot be used to carry out a heat treatment at constant temperatures, since the air in the yarn guide tube does not have a defined temperature.

DE-A-2,927,032 discloses apparatus for texturing yarns wherein the yarns are heated directly in yarn ducts through which hot air flows. The yarn ducts are supplied with hot air and are connected to a suction tube. The apparatus is characterized by a special arrangement of the inlet and outlet lines for the hot air and the heating apparatus for the hot air; furthermore, inlet and outlet ports are provided on the yarn ducts for feeding and discharging the yarns. The apparatus described is intended to achieve accurate temperature control and high temperature uniformity within the apparatus. The yarns are directly surrounded by a uniform stream of hot air, which ensures uniform heating of the yarns at a constant temperature and air speed. The apparatus requires aspiration of the spent hot air via a separate suction tube.

DE Utility Model 83 12 985 discloses apparatus for texturing yarns wherein there is provided a heating apparatus in which hot air heats a moving yarn in a yarn duct. The apparatus is characterized by the special air guidance system in the yarn duct, having one feed line between at least two return lines for the hot air. The apparatus is intended to minimize the temperature drop in the yarn duct between the inlet and outlet thereof. The yarn is impinged by the hot air at one point as in an injector nozzle, and then the yarn and the air move together or in opposite directions, the air giving off its heat.

GB-A-1,216,519 discloses a process for heating a thermo-plastic yarn using a contact heater. In this process, a continuously moving yarn passes through a yarn duct in the form of a capillary. The internal diameter of the yarn duct is such that fluids cannot move freely within this duct but, because of the capillary nature of the yarn duct, produce a sealing effect. This yarn duct is charged with a pressurized heating fluid, for example air, superheated steam or saturated steam, so that it can move through the heating duct together with the yarn in the yarn transport direction and plasticates the yarn by contact. Owing to the construction of this apparatus, it has to be assumed that a steep temperature gradient will develop in the yarn duct in the yarn transport direction and that, as a consequence of the small amounts of heating fluid in the capillary of the yarn duct, it is necessary to operate at a heating fluid temperature which is far above the desired yarn temperature.

DE-C-967,805 discloses a process and apparatus for setting moving yarns as they are being false twisted. The process consists in the contactless movement of a surface-moistened high-twist yarn through a heating apparatus which contains hot air. The false twist is set by utilizing a high relative movement between the hot air and the moving yarn. According to the description, the process is carried out in such a way that a high temperature gradient forms between the hot air and the yarn; the moistening of the surface accordingly is designed to protect the yarn from thermal damage.

DE-B-1,908,594 discloses apparatus for heat treating relaxed synthetic yarns wherein a yarn is passed through a hollow heating cylinder. The yarn inlet is equipped with an injector in the form of an annular nozzle driven by a primary gas stream of heating gas, and with an additional inlet for a secondary gas stream. The apparatus is characterized in that the additional inlet for the secondary gas stream is arranged in such a way that this stream meets the primary gas stream in the heating cylinder at a point, viewed in the transport direction of the yarn, behind the injector outlet. The apparatus is intended to avoid the formation of vortices in the heating cylinder, and the quality of the treated yarns is to be improved. Vortexing is a danger because the primary gas stream enters the heating cylinder at a relatively high speed and slows down therein.

DE-A-2,347,139 discloses a process for texturing thermoplastic yarn by setting the twisted yarn by means of hot steam passed through the heating means at the speed of sound. The heating medium is here likewise fed in at the yarn inlet point of the heating apparatus by means of an annular nozzle. The process is notable for high productivity. The heating of the yarn is effected by contact with a comparatively small mass of the steam in fast, turbulent flow, this steam having an elevated temperature compared with the desired final temperature of the moving yarn.

Finally, DE-A-3,344,215 discloses a yarn heater comprising a heated yarn tunnel. This heater is characterized in that it contains means through which a heated medium impinges on a yarn moving along this tunnel in the region of the yarn inlet. The heating medium is here likewise fed in by means of an annular nozzle. The heater is intended to increase the heating power, so that shorter heaters than previously customary can be used. Details of the temperature course in the yarn duct are not revealed.

These prior art methods for heating fast moving yarns thus involve in some instances setting the heating unit to very high temperatures in order that the desired temperatures may be obtained on the moving yarn during short residence times, or relatively large temperature gradients in the yarn duct of the heating means, since, for example, turbulence arises in the heating medium. Inevitably, the heating will be nonuniform from out to in into the yarn or yarn bundle. The quality of the treated yarns or yarn bundles accordingly leaves in general something to be desired. It is found, in general, that rapid heating with an excessive temperature difference can lead to a loss of strength of the yarn or to uneven dye uptake by the yarn, since parts of the yarn bundle are heated nonuniformly.

Other prior art heating processes, intended to maximize the uniformity of the heating of the yarn in the yarn duct, require a special form of guiding the heating medium and are expensive to implement.

It is an object of the present invention to provide a simple process for heat treating contactlessly moving yarns whereby gentle and very uniform heating of the yarns is possible.

It has now been found, surprisingly, that yarns moving contactlessly through a heating apparatus can be heated to a desired elevated temperature in a gentle manner; this heating is particularly suitable for treating fast moving yarns.

The process of the invention comprises the following measures:

i) preheating a heat transfer gas to a temperature which is above the desired yarn temperature, and
ii) feeding the preheated heat transfer gas into the yarn duct so that it impinges essentially perpendicularly on the moving yarn along a length such that the yarn heats up to the desired elevated temperature within the heating apparatus, the length of the impingement zone being such that continuous removal of the boundary layer by the impinging heat transfer gas ensures that the yarn comes into direct contact with the heat transfer gas and thus heats up very rapidly.

In the process of the invention, the uniformly heated heat transfer gas impinges on the yarn over a certain length, so that the heat transport process is due more to the movement of the heat transfer gas (convection) than to heat transmission by temperature gradient. This form of impingement strips the yarn of its thermally insulating boundary layer of air over a considerable length and makes it possible for the hot heat transfer gas to release its heat to the yarn rapidly and uniformly. For this the temperature of the heat transfer gas need be only a little above the yarn temperature, since the bulk of the heat is transferred by convective air movement and only a relatively small proportion by temperature gradient. This convective form of heat transmission is very efficient and, what is more, overheating of the yarn material is avoided, making gentle and uniform heating a reality.

For the purposes of the present invention the term "yarn" includes not only multifilament yarns but also staple yarns and monofilaments. Depending on the field of use, the yarn will usually have a linear density of from 50 to 2500 dtex, preferably from 50 to 300 dtex (for textile purposes) or from 200 to 2000 dtex (for industrial purposes).

As regards the fiber-forming material, the process of the invention is not subject to any restrictions. It is possible to use not only yarns made of inorganic material, for example glass, carbon or metal yarns, but also yarns made of organic material, for example yarns based on aliphatic or aromatic polyamide, polyesters, in particular polyethylene terephthalate, or polyacrylonitrile.

In the process of the invention, the moving yarn is passed through the heating apparatus by applying a tension. This tension can be varied within wide limits, for example in order to confer desired shrinkage or extensibility characteristics on the yarn. The tension chosen has to be such that the yarn moves through the yarn duct contactlessly and that no or only insignificant orientation takes place or that shrinkage of the yarn takes place.

The heat transfer gas used can be any gas which under the particular treatment conditions is inert toward the yarn to be heated. Examples of gases of this type are nitrogen, argon and in particular air. The gas may also contain additaments, for example a certain moisture content; however, the moisture content must not be so high as to result in significant condensation on the yarn in the heating apparatus.

"Fast moving" for the purposes of the present invention denotes speeds of more than 300 m/min, preferably from 400 to 6000 m/min, in particular from 400 to 3000 m/min; these particulars relate to the speed of the yarn at the instant of leaving the heating apparatus.

The heat transfer gas can be preheated in a conventional manner, for example by contact with a heat exchanger, by passing through heated tubes or by direct heating via heating spirals. The temperature of the preheated heat transfer gas is above the particular yarn temperature desired; the heat transfer gas preferably has a temperature of up to 20° C. above the desired yarn temperature, and it is preferable to ensure that no significant temperature drop occurs between the preheating and the actual heating of the yarn.

The hot heat transfer gas can be introduced into the yarn duct at any desired point. It is preferably introduced into the yarn duct in such a way that it can come into contact with the yarn along the entire yarn duct. The length of the impingement zone is preferably more than 6 cm, in particular from 6 to 200 cm. If the heating apparatus is integrated into a drawing operation, the impingement zone is preferably from 6 to 20 cm in length. If the heating apparatus is integrated into a setting operation, the impingement zone is preferably from 6 to 120 cm, in particular from 6 to 60 cm, in length.

The heat transfer gas is preferably introduced into the yarn duct perpendicularly to the yarn transport direction, the heat transfer gas on the one hand being carried along by the moving yarn and leaving the heating apparatus together with the moving yarn via the yarn outlet and, on the other, moving in the direction opposite to the yarn transport direction and leaving the heating apparatus via the yarn inlet.

In a preferred embodiment, the heat transfer gas is blown perpendicularly onto the yarn from small openings in the middle portion of the yarn duct over a length of about ¼ to ½ of the duct length and escapes from the yarn duct in the yarn transport direction and in the opposite direction. In a similarly preferred modification of this embodiment, the gas is blown in transversely and aspirated away on the opposite side.

The contacting in the heating apparatus of the moving yarn with the heat transfer gas shall take place under such conditions that the yarn heats up to the desired elevated temperature within the heating apparatus and the heat transfer gas virtually cools down only very little in the heating apparatus.

The person skilled in the art has a number of measures at his or her disposal for achieving these requirements. For instance, it is possible to have the heat transfer gas flow through the yarn duct at a relatively high weight per unit time, relative to the yarn weight moving through the yarn duct per unit time, so that, notwithstanding the effective and rapid transmission of heat to the yarn, the heat transfer gas cools down only slightly. Unlike impingement on the moving yarn at virtually one spot, impingement along a certain zone ensures a particularly intensive interaction of the heating gas with the yarn, since the boundary layer between the yarn and the surrounding medium is continuously stripped away in this zone. In this way it is possible to achieve effective heating of the yarn even with only a small change in the temperature of the gas. Furthermore, the temperature course of the heat transfer gas can be controlled in a conventional manner via the thermal capacity of the gas or its flow velocity.

In a particular embodiment, the heating is controlled by single-location or group control in such a way that the yarn is at a predetermined temperature by controlling the heating via a control circuit with one or more sensors in the vicinity of the yarn. Since the time constant of electronic control circuits is below 1 second, they make it possible to achieve a very short start-up phase, reducing the proportion of off-spec start-up material and eliminating winding waste and the need to switch to saleable packages.

In general there is only a negiglible change of the temperature of the heating apparatus under operating conditions thus heat transfer gas in the this gas does not undergo any significant change in temperature on passing through the heating apparatus. This can be achieved with suitable insulation of the gas-conducting parts of the apparatus.

It is a particular advantage that the above-described temperature control system makes it possible to disregard the heat losses between the heating apparatus and the yarn, since the heating apparatus is controlled according to the temperature close to the yarn. This makes it possible to avoid expensive wall heating in the air duct between the heating apparatus and the yarn. Even local fluctuations in the insulating effect can be eliminated by this form of control.

The process of the invention is suitable for example for heating textured yarns, in particular air Jet textured yarns, and for heating high modulus yarns prior to the intermingling of these yarns.

Particular advantages arise on setting yarns having protruding filament ends or loops and improved cohesion compared with unset yarns, where the gentle heating makes it possible to avoid even incipient melting of the protruding parts. The conventional setting processes for yarns having protruding filament ends or loops employ hot plates, hot rails or heated godets, which are heated to a temperature appreciably higher than the setting temperature in order to achieve sufficiently rapid heat transmission. This procedure is limited by the fact that protruding filament ends or loops in direct contact with the heater will melt, since they attain the high temperature of the heating element much more rapidly than the compact yarn, which heats up very much more slowly on account of its larger mass. The melting of the filament ends or loops results in sticky areas or deposits on the heater surface, which impair the running of the yarn. Moreover, the relatively severe shrinkage and melt effect reduces the number of loops per unit length. Incipiently melted filaments become brittle, which can lead to severe abrasion in the course of further processing, for example in the course of sewing. Setting the compact yarn at relatively high speeds while preserving the number of loops per unit length is therefore difficult to achieve with these methods. Even a contactless heat treatment of the yarn, for example in a heating tube, requires appreciable overheating of the walls in order that the desired setting temperature in the compact yarn may be obtained as a result of adequate heat transmission. This gives rise to essentially the same effects and disadvantages as described above for contact heating.

It has now been found that these difficulties can be appreciably reduced by allowing a hot gas to flow through the moving yarn by forced convection. This ensures a sufficiently rapid supply of heat to the yarn in order that the desired setting temperatures may be achieved in the yarn. It is a particularly great advantage that the heating gas need only be heated to a little above the setting temperature, since the transmission of heat is not solely dependent on the temperature gradient, but is essentially determined by the flow of the hot gas. The minimal overheating of the hot gas prevents premature melting of the protruding filament ends or loops, so that the setting temperature is achieved in the compact yarn without any excessively adverse effect on the heat-sensitive filament ends or loops. The upper limit for the temperature of the heating gas shall be the melting point of the protruding filament ends or loops. In the case of yarns based on polyethylene terephthalate, this upper limit is about 270° C.

The invention also provides a process of this kind.

The process is particularly advantageous for manufacturing sewing yarns.

In a particularly preferred version, the process of the invention can be used in the production of two-component loop sewing yarns. The invention therefore also provides a process of this kind, which comprises the following steps:

a1) feeding two or more feed yarn strands into a texturing nozzle at different speeds, a2) intermingling the feed yarn strands in the texturing nozzle to form a yarn consisting of core and effect filaments and having loops formed chiefly of effect filaments on its surface, b1) withdrawing the primary two-component loop sewing yarn under tension so that the primary yarn becomes mechanically stable with a reduction in the loop size, b2) passing the stabilized primary yarn into and through the interior of a heating apparatus, and c) impinging this moving yarn in the heating apparatus with a heat transfer gas, the impinging of the yarn with the heat transfer gas being effected in accordance with the above-defined steps i) and ii), so that the moving yarn heats up to the desired elevated temperature within the heating apparatus and the loops are heat set in the loop form.

In preferred embodiments of this version of the process of the invention, the feed yarn strands have different total and filament linear densities and the feed yarn strands consist of high strength, low shrinkage and low extension filaments, in particular of filaments drawn by the process according to the invention.

In a further preferred embodiment of this version of the process of the invention, the core and effect filaments consist of polyester, in particular polyethylene terephthalate or polyethylene terephthalate copolymer, the feed yarn strands are obtained by drawing a partially oriented yarn material and an immediately subsequent, essentially shrinkage-free heat treatment, and, immediately following this heat treatment, the texturing nozzle is overfed with the core filaments at an overfeed rate of from 3 to 10% and with the effect filaments at an overfeed rate of from 10 to 60%.

The drawing of the feed yarn strands is usually effected at from 70° to 100° C. at below from 10 to 330 cN/tex, based on the drawn linear density.

The setting temperature in the production of a two-component loop sewing yarn is usually from 200° to 320° C., preferably from 220° to 240° C., so that the heat transfer gas of step c) is heated to that temperature.

The residence time RT (in seconds) in the heating apparatus of the yarns to be set is preferably such as to obtain a distinct structural change to the set yarns. This structural change can be expressed in terms of a setting effect SE by the following formulas $$SE = a_5 * RT * exp(0.03*(T-100)*A_6)$$

where $a_5* = 1*(1/sec)$, $a_6 = 1*(1/°C.)$, and T is the temperature of the heat transfer gas in °C.

SE is preferably equal to or greater than 22.5, in particular from 25 to 300. The core filaments usually have a linear density of from 1.2 to 8 dtex and the effect filaments usually have a linear density of from 1 to 4.5 dtex. The linear density of the two-component loop sewing yarn is usually from 200 to 900 dtex.

This version of the process according to the invention makes it possible to produce in particular two-component loop sewing yarns of high tenacity and low shrinkage, in particular grades having a final tenacity of above 40 cN/tex, a heat shrinkage at 180° C. of below 8% and a breaking extension of below 18%.

The production of two-component loop sewing yarns is known per se; see for example EP-A-57,580 and in particular U.S. Pat. No. 5,100,729. The subject matter of these publications also forms part of the subject matter of the present disclosure.

The present invention further provides a particularly adapted apparatus for carrying out the process of the invention.

The apparatus in question is an apparatus for heating moving yarns (1) to a desired elevated temperature, comprising a preheating means (2) for the heat transfer gas (12), a duct (3) for the contactlessly moving yarn in the form of a tube (7) drilled with a plurality of holes (6) for the passage of the heat transfer gas (12) which are arranged in the yarn transport direction, at least one feed line (4) for the hot heat transfer gas (12) having at least one outlet (5) into a distributor chamber (13) from where the hot heat transfer gas (12) flows into the duct (3), the holes (6) in the tube (7) being such that the heat transfer gas (12) can impinge radially from the outside on the yarn moving contactlessly in the duct (3).

The length of the yarn duct is usually from 10 to 200 cm, preferably from 10 to 15 cm or from 70 to 160 cm. The diameter of the yarn duct is usually from 4 to 25 mm, preferably from 5 to 15 mm.

Further particularly preferred embodiments of the apparatus according to the invention are defined in claims 17 to 23.

It is of course also possible for a plurality of yarn ducts (3) to be combined in one unit and supplied with the heat transfer gas (12) via one or more feed lines (4).

Figure 2:
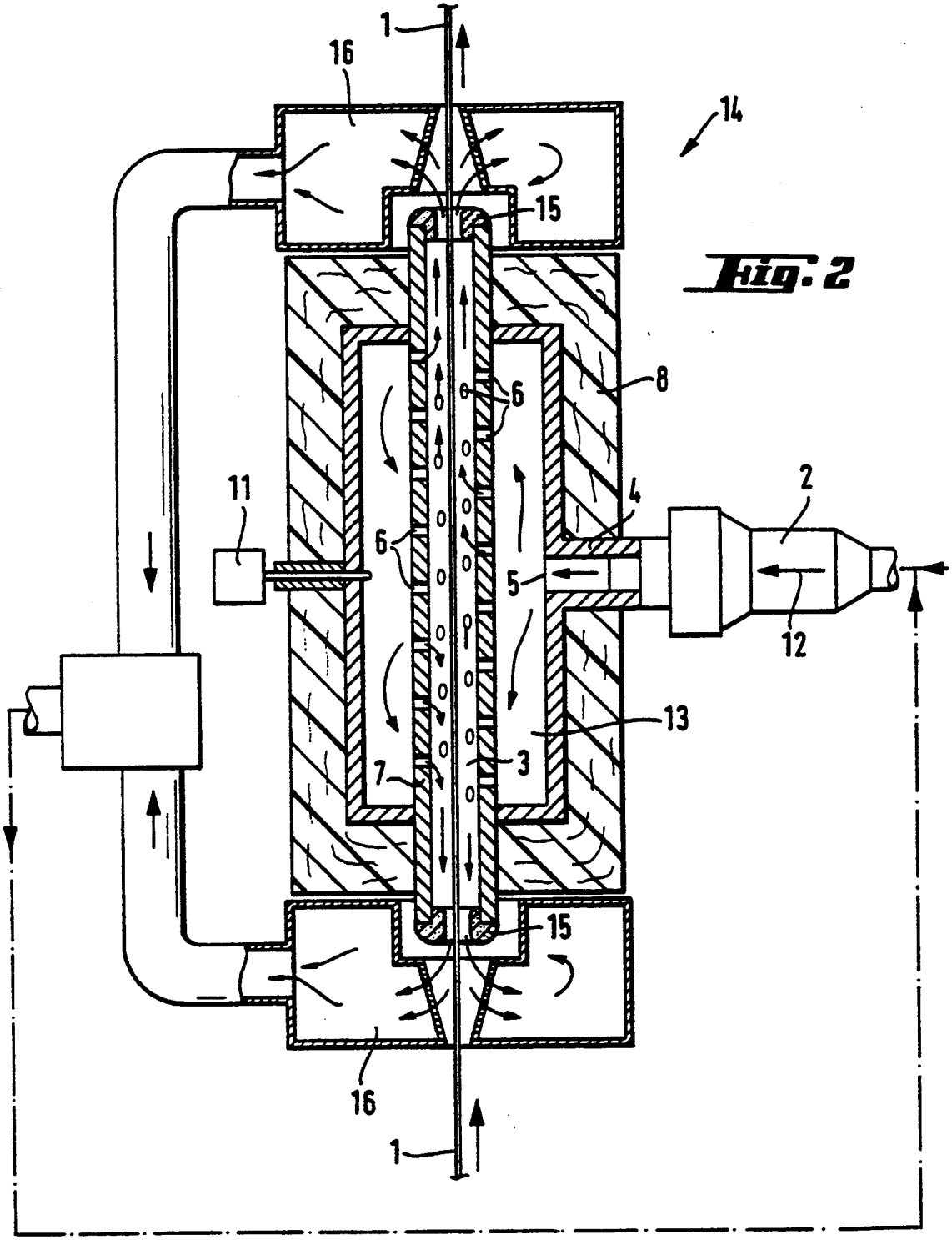

The following FIGS. 1 and 2 each depict apparatus according to the invention in longitudinal section by way of example.

FIG. 1 is a diagrammatic depiction of a setting or drawing means in which a yarn (1) is passed to a heating means (14) via a pair of feed godets (9) and transported away again via a pair of take-off godets (10), which can also serve as a pair of setting godets.

The heating apparatus (14) has a yarn duct (3) formed by a tube (7). This tube (7) is impinged perpendicularly by a hot heat transfer gas (12), for example hot air which has been heated to the desired temperature in a preheating means (2), for example by means of a heating spiral, and passes through a feed line (4) and an outlet (5) into a distributor chamber (13). The tube (7) has on its surface, along its entire length, a multiplicity of drilled holes (6) through which the heat transfer gas (12) can pass radially from the distributor chamber (13) into the duct (3). The pressure and temperature of the heat transfer gas in the distributor chamber (13) are monitored by means of the pressure and temperature sensor (11), which is coupled, advantageously via a control system (11*a*), to the preheating means (2) and the supply (not depicted) for the heat transfer gas. The heating apparatus (14) is surrounded by insulation (8).

FIG. 2 depicts in diagrammatic form a further embodiment of the heating apparatus (3) of the invention showing, as in the case of the apparatus of FIG. 1, the yarn (1), the yarn duct (3), the tube (7), the heat transfer gas (12), the preheating means (2), the feed line (4), its outlet (5), a distributor chamber (13), holes (6) in the tube (7), pressure and temperature sensor (11) and insulation (8). The apparatus of FIG. 2 further comprises inlet and outlet nozzles (15) and (16) respectively at the ends of the yarn duct, advantageously made of ceramic material. There is in addition provided a suction means (16) for the heat transfer gas emerging from the yarn duct.

In a particularly preferred embodiment of the process according to the invention, air is heated to a desired temperature, for example to 250°-300° C., in an electric heat exchanger, for example with a heating spiral. The hot air passes through the feed line (4) into the distributor chamber (13), where it becomes uniformly distributed around the tube (7) and passes through the holes (6) onto the moving yarn (1) from all sides. The holes (6) usually have a diameter of from 1 to 2 mm. In the yarn guide tube (7) the air is deflected after contact with the yarn and flows away in the yarn transport direction and in the opposite direction. This prolongs the contact time between the yarn and the hot air. Instead of the drilled holes (6) there may also be provided other openings, such as slots, screens or sintered metals.

In the depicted particularly preferred embodiment, the holes (6) not only surround the yarn from all sides, but are also distributed along the yarn path. As a result, the yarn is impinged by hot air over a certain length, and the air boundary layer which is adhering in this region and which has already transmitted its heat content to the yarn is removed over a greater length and new hot air can take its place. In the case of a single impingement this boundary layer is removed only at one point on the yarn and the air in the immediate vicinity of the yarn cools down as a result of heat transmission to the yarn, so that it is usually necessary to overheat the heat transfer gas to an appreciable extent to achieve sufficiently rapid heating.

A yarn guide tube length of about 6 to 20 cm is sufficient for drawing. It is advantageous to use a yarn guide tube length of about 70 to 200 cm in setting processes.

A suitable value for the rate of throughput of heat transfer gas through the heating apparatus can be estimated by means of an $x_L$ value, which should preferably be exceeded. This $x_L$ value is calculated by the following formula:

$$x_L = 1.5*10^{-5}*(v*fd*c_{pf})/(q_L*c_{pl})$$

where $x_L$ = gas throughput in standard $m^3/h$

V = yarn speed in m/min fd = yarn linear density in dtex $C_{pf}$ = heat capacity of the yarn material in kJ/Kg*K $q_L$ = density of the heat transfer gas in $kg/m^3$ $C_{pl}$ = heat capacity of the heat transfer gas in kJ/Kg*K Preferred $x_L$ values for a certain combination of yarn material and heat transfer material vary from within the range of the values calculated by the above formula to four times this value. A customary $x_L$ value is 2.2 standard $m^3m/h$.

The Examples which follow describe the invention without limiting it. The viscosity data given in these Examples relate to the intrinsic viscosity, measured on solutions of the polyester in o-chlorophenol at 25° C.

The tenacity and the breaking extension are determined in accordance with DIN 53834.

Shrinkage is initiated by heat treatment in a through-circulation oven at 200° C. for a residence time of 5 minutes and then measured under a load corresponding to a weight of 500 meters of the starting yarn.

The loop tenacity is determined according to DIN 53834 Part 1.

The sewing test is carried out at 5000 stitches/min and 4 stitches/cm using 4 plies for the forward seam and 2 plies for the return seam.

Examples 1 to 6

High modulus low shrinkage (HMLS) yarns based on polyethylene terephthalate (PET) and produced using the heating process of the invention were compared with commercially available HMLS PET yarns. The filaments were spun at different take-off speeds and further processed to form core yarn. The strength gain of the yarns produced according to the invention survives the further processing to sewing yarns. The sewing results are good. The results are shown in the table below.

| | Example No.: | | | | | |
|---|---|---|---|---|---|---|
| | 1 | 2 | 3 | 4 | 5 | 6 |
| Spinning data | | | | | | |
| Take-off speed (m/min) | 3000 | 2000 | 3000 | 3000 | 1000 | commercially available |
| As-spun linear density (dtex) | 215/48 | 410/32 | 300/32 | 300/48 | 606/32 | HMLS PET yarn |
| Filament: | | | | | | |
| Linear density (dtex) | 95 | 139 | 135 | 126 | 131 | 275 |
| Tenacity (cN/tex) | 78.7 | 72.2 | 74 | 74.6 | 77.5 | 70 |
| Breaking extension (%) | 9.2 | 12.2 | 11.7 | 10.7 | 12.6 | 16.2 |
| Shrinkage (200° C.) | 5 | 5.9 | 5.4 | 4.0 | 5.4 | 4.4 |
| Loop tenacity (cn/tex) | 42 | 39 | 39 | 45 | 40 | 44.5 |
| Folded yarn after dyeing: | | | | | | |
| Linear density (dtex) | 200 | 299 | 291 | 271 | 290 | |
| Tenacity (cN/tex) | 68.7 | 63.2 | 63.5 | 59 | 63.6 | 64.4 |
| Breaking extension (%) | 16 | 17.6 | 16.8 | 15 | 18.1 | |
| Shrinkage (180°) % | 0.7 | 0.9 | 0.8 | 0.6 | 1.9 | |
| Loop tenacity | 40 | 35 | 36 | 29 | 37 | |

-continued

| | Example No.: | | | | | |
|---|---|---|---|---|---|---|
| | 1 | 2 | 3 | 4 | 5 | 6 |
| (cN/tex) | | | | | | |
| Core yarn after dyeing: (S 782*2/Z 729) | | | | | | |
| Linear density (dtex) | | 418 | 409 | 392 | 402 | |
| Tenacity (cN/tex) | | 47.8 | 47.8 | 48.2 | 54.2 | 45 |
| Breaking extension (%) | | 14.4 | 13.8 | 13 | 14.1 | |
| Shrinkage (180°) % | | | | | | |
| Loop tenacity (cn/tex) | | 33 | 34 | 31 | 34 | |
| Sewing test: Double quilt stitch 5000 stitches/min | | | | | | |
| Forward | >4000 | >4000 | >4000 | >4000 | >4000 | >4000 |
| Return | >2000 | >2000 | >2000 | >2000 | >2000 | >2000 |

The yarns produced according to the invention were produced in a single stage on a commercial draw-twist machine modified with the heating apparatus of the invention. This modified draw-twist machine was operated with the following settings (drawing speed=500 m/min):

| Ex. No. | Draw ratio 1: | Temperatures Feed godet | Hot air | Take-off godet | Intrinsic viscosity of PET used |
|---|---|---|---|---|---|
| 1 | 2.4 | cold | 320 | 230 | 0.75 |
| 2 | 3.1 | cold | 280 | 230 | 0.75 |
| 3 | 2.3 | cold | 280 | 230 | 0.75 |
| 4 | 2.5 | cold | 280 | 230 | 0.66 |
| 5 | 5.0 | 78 | 250 | 230 | 0.75 |

Examples 7 to 12

HMLS PET yarns produced by the drawing process of the invention were compared with conventionally produced HIMLS yarns (Example 12). The filaments were spun at different take-off speeds. The strength gain survives the further processing to sewing yarn and the sewing properties are very good.

| | Ex. No.: | | | | | |
|---|---|---|---|---|---|---|
| | 7 | 8 | 9 | 10 | 11 | 12 |
| Spinning data: | | | | | | |
| Take-off speed (km/min) | 1 | 1 | 1 | 2 | 3 | 1 |
| As-spun linear density (dtex) | 606/32 | 566/48 | 566/48 | 620/64 | 430/96 | |
| Filament: | | | | | | |
| Linear density (dtex) | 133 | 144 | 142 | 197 | 190 | 275 |
| Tenacity (cN/tex) | 78.8 | 77.3 | 76 | 73.1 | 77.6 | 70 |
| Breaking extension % | 13 | 12.6 | 11.4 | 11.7 | 11 | 16.2 |
| Shrinkage (200°) % | 7.4 | 5.2 | 5.7 | 5.5 | 4.3 | 4.4 |
| Loop tenacity (cN/tex) | 37 | | | 47 | 50.2 | 44.5 |
| Gray-state Folded yarn: | | | | | | |

-continued

| | Ex. No.: | | | | | |
|---|---|---|---|---|---|---|
| | 7 | 8 | 9 | 10 | 11 | 12 |
| Linear density (dtex) | 266.3 | 295.4 | 292.4 | 400.6 | 391.9 | 561.4 |
| Tenacity (cN/tex) | 73.1 | 69.8 | 72.3 | 68.1 | 72.2 | 64.4 |
| Breaking extension % | 14 | 13.4 | 13.6 | 13.6 | 12.2 | 16.8 |
| Shrinkage (180°) %) | 5.7 | 4.6 | 4.4 | 3.7 | 306 | 2.6 |
| Folded yarn after dyeing: | | | | | | |
| Linear density (dtex) | 278.2 | 306.3 | 304.8 | 421.9 | 404.7 | 578.8 |
| Tenacity (cN/tex) | 68.4 | 66.9 | 68.0 | 65.3 | 68.9 | 60.5 |
| Breaking extension % | 19.6 | 17.7 | 17.7 | 17.4 | 15.4 | 17.8 |
| Shrinkage (180°) % | 1.2 | 0.7 | 0.4 | 0.5 | 0.7 | 1 |
| Loop tenacity | 37 | 37.9 | 41.3 | 40.5 | 38.2 | 37.1 |
| Sewing test: Double quilt stitch 5000 stitches/min | | | | | | |
| Forward | >4000 | >4000 | >4000 | >4000 | >4000 | >4000 |
| Return | >2000 | >2000 | >2000 | >2000 | >2000 | >2000 |

The yarns produced according to the invention were obtained in a single stage on a modified commercial draw-twist machine (feed godets, heating apparatus of invention, take-off godets, head) using the following settings (drawing speed=600 m/min, intrinsic viscosity: 0.76):

| Ex. No. | Draw ratio | Temperatures Feed godet | Hot air | Take-off godet |
|---|---|---|---|---|
| 7 | 5.0 | 70 | 250 | 230 |
| 8 | 4.2 | 70 | 220 | 240 |
| 9 | 4.2 | 50 | 220 | 250 |
| 10 | 3.3 | 40 | 280 | 250 |
| 11 | 2.5 | 40 | 280 | 240 |

Examples 13 to 19

The setting effect of the process of the invention is compared with hot air setting and heating rail in the case of air-textured sewing yarns. The sewing yarns are produced by the process known from EP-A-0363792. The product is a loop sewing yarn having the following specification:

Effect thread: 83f24 dtex

Core thread: 380f40 dtex

Draw ratio: core/effect thread=2.1

Intrinsic viscosity: 0.68

The following results were obtained:

Comparison heating rail (HR) to hot air (HA) setting of air-textured sewing yarns.

| | Example No.: | | | | | | |
|---|---|---|---|---|---|---|---|
| | 13 | 14 | 15 | 16 | 17 | 18 | 19 |
| Apparatus | HR | HR | HA | HA | HA | HA | HA |
| Setting temp. (°C.): | 200 | 230 | 255 | 245 | 300 | 276 | 301 |
| Setter length (mm): | 2000 | 2000 | 1000 | 1600 | 1600 | 1600 | 1600 |
| Yarn speed (m/min): | 300 | 300 | 300 | 300 | 300 | 600 | 600 |
| Ecru: | | | | | | | |
| Tenacity (c/N/tex) | 34.4 | 36.8 | 33.1 | 45.4 | 51.7 | 48.4 | 44.9 |
| Breaking extension (%): | 11.4 | 12 | 11.4 | 12 | 11.9 | 13 | 11.1 |
| Shrinkage (200° C.): | 11.3 | 9.5 | 7 | 5 | 4.6 | 6.4 | 5.4 |
| Dyed: | | | | | | | |
| Tenacity (cN/tex) | 31.1 | 32.7 | 32.6 | 40.3 | 47.1 | 38.9 | 36.5 |
| Breaking extension (%): | 19.1 | 16.8 | 17 | 13.1 | 14.4 | 19.6 | 19.1 |
| Shrinkage (180° C.): | 2.2 | 1.7 | 1.4 | 0.6 | 0.7 | 0.7 | 0.8 |
| Sewing lengths: | | | | | | | |
| Forward | >4000 | >4000 | >4000 | >4000 | >4000 | >4000 | >4000 |
| Return | >2000 | >2000 | >2000 | >2000 | >2000 | >2000 | >2000 |

The Examples show that the contact heater (Examples 13 and 14) and hot air heater of insufficient length (Example 15) do not produce the desired HMLS properties.

Effect of HA heater length, yarn speed, residence time and air temperature on change in structure (setting effect).

| Ex. No. | Speed m/min | Temp. °C. | Length m | Residence time (sec) | Change in structure |
|---|---|---|---|---|---|
| 14 | 300 | 255 | 1 | 0.2 | 20.9 |
| 15 | 300 | 245 | 1.6 | 0.32 | 24.8 |
| 16 | 300 | 300 | 1.6 | 0.32 | 129 |
| 17 | 600 | 276 | 1.6 | 0.26 | 31.4 |
| 18 | 900 | 301 | 1.6 | 0.11 | 44.3 |

Change in structure (setting effect=residence time *Exp (0.03*(temp. −100))

What is claimed is:

1. A process for heating to a desired elevated temperature, moving yarns having a surrounding boundary layer of gas, said yarns passing contactlessly through a heating apparatus having a yarn duct with a middle portion along a path, comprising the steps of:

i) preheating a heat transfer gas to a temperature which is above the desired elevated temperature, and ii) feeding the preheated heat transfer gas into the yarn duct so that the heated gas impinges essentially perpendicularly on the moving yarn along a length such that the yarn heats up to the desired elevated temperature within the heating apparatus, and iii) continuously removing of the surrounding boundary layer of gas with the impinging heat transfer gas to ensure that the yarn comes into direct contact with the heat transfer gas.

2. The process of claim 1, further comprising the step of selecting nitrogen, argon or air as the heat transfer gas.

3. The process of claim 1, further comprising the step of applying the heat transfer gas to the yarn essentially along the entire path of the yarn in the heating apparatus.

4. The process of claim 1, wherein during the step of feeding the preheated heat transfer gas into the yarn duct, the heat transfer gas is fed into the yarn duct such that the heated gas impinges on the moving yarn radially.

5. The process of claim 1, wherein during the step of feeding the preheated heat transfer gas into the yarn duct, the heat transfer gas is blown perpendicularly onto the yarn from small openings in a middle portion of the yarn duct over a length of about ¼ to ½ of the duct length and escapes from the yarn duct in the yarn transport direction and in the opposite direction.

6. The process of claim 1, further comprising the step of controlling the heating with a control circuit with one or more sensors in close proximity to the yarn, such that the yarn remains at a pre-determined temperature.

7. A process for heating to a desired elevated temperature, moving yarns having a surrounding boundary layer of gas, said yarns passing contactlessly through a heating apparatus having a yarn duct with a middle portion along a path, comprising the steps of:

i) preheating a heat transfer gas to a temperature which is above the desired elevated temperature, and ii) feeding the preheated heat transfer gas into the yarn duct so that the heated gas impinges essentially perpendicularly on the moving yarn along a length such that the yard heats up to the desired elevated temperature within the heating apparatus, the length of preheated heat transfer gas impingement being such that continuous removal of the surrounding boundary layer of gas by the impinging heat transfer gas ensures that the yarn comes into direct contact with the transfer gas wherein the heat transfer gas throughput through the heating apparatus in standard $m^3/h$ is at least $X_L$, $X_L$ being determined by the formula $$X_L = 1.5 \bullet 10^{-5} \bullet (v \bullet fd \bullet c_{pf}) / (q_L \bullet c_{pl})$$

where v is the yarn speed in m/min, fd is the yarn linear density in d/tex, $c_{pf}$ is the heat capacity of the yarn material in kJ/(kg•K), $q_L$ is the density of the heat transfer gas in $kg/m^3$, and $c_{pl}$ is the heat capacity of the heat transfer gas in kJ/(kg•K).

8. The process of claim 7, wherein the heat transfer gas throughput through the heating apparatus is between $X_L$ and 4 *$X_L$.

9. A process for producing set yarns having a surface and protruding filament ends or loops and improved cohesion compared with unset yarns, by heating the yarns during a residence time in an apparatus having an interior comprising the steps of:

a) forming a yarn having individual filament ends protruding from the surface thereof or a yarn having loops of individual filaments on the surface thereof, b) contactlessly passing the yarn through the interior of the heating apparatus, and c) impinging the moving yarn in the heating apparatus with a heat transfer gas, the impinging of the yarn with the heat transfer gas being effected by preheating a heat transfer gas to a temperature which is above a desired elevated temperature, and feeding the preheated heat transfer gas into a yarn duct so that impingement by the heated gas is essentially perpendicular to the moving yarn in the duct along a length such that the yarn heats up to the desired elevated temperature within the heating apparatus and the filament ends or loops are heat set.

10. The process of claim 9 further comprising the steps of:

a1) feeding two or more feed yarn strands into a texturing nozzle at different speeds, a2) intermingling the feed yarn strands in the texturing nozzle to form a primary yarn having core and effect filaments and having loops formed chiefly of effect filaments on a surface of the primary yarn, b1) withdrawing the primary loop yarn under tension to stabilize the primary yarn and simultaneously reduce loop size, b2) passing the stabilized primary yarn into and through the interior of the heating apparatus, wherein a two-component loop sewing yarn is formed.

11. The process for producing a two-component loop sewing yarn as claimed in claim 10, wherein the feed yarn strands have different total and filament linear densities and the feed yarn strands consist of high-tenacity low-shrinkage and low-extension filaments.

12. The process as claimed in claim 10, wherein the core and effect filaments are polyester and the feed yarn strands are obtained by drawing a partially oriented yarn material then immediately subsequently conducting an essentially shrinkage-free heat treatment, and, immediately following this heat treatment, over feeding the texturing nozzle with the core filaments at an overfeed rate of from 3 to 10% and with the effect filaments at an overfeed rate of from 10 to 60%.

13. A process as claimed in claim 12 wherein the core and effect filaments are polyethylene terephthalate or polyethylene terephthalate copolymer.

14. The process for producing a two-component loop sewing yarn as claimed in claim 10, wherein the heat transfer gas has been heated to a temperature of from 200° to 320° C.

15. A process for producing set yarns having a surface and protruding filament ends or loops and improved cohesion compared with unset yarns, by heating the yarns during a residence time in an apparatus having an interior comprising the steps of:

a) forming a yarn having individual filament ends protruding from the surface or a yarn having loops of individual filaments on the surface, b) contactlessly passing the yarn through the interior or a heating apparatus, and c) impinging this moving yarn in the heating apparatus with a heat transfer gas, the impinging of the yarn with the heat transfer gas being effected by, i) preheating a heat transfer gas to a temperature which is above the desired elevated temperature, and ii) feeding the preheated heat transfer gas into the yarn duct so that the heated gas impinges essentially perpendicularly on the moving yarn along a length such that the yarn heats up to the desired elevated temperature within the heating apparatus, the length of preheated heat transfer gas impingement being such that continuous removal of the surrounding boundary layer of gas by the impinging heat transfer gas ensures that the yarn comes into direct contact with the heat transfer gas, so that the moving yarn heats up to the desired elevated temperature within the heating apparatus and the lops are heat set in the loop form, wherein the residence time RT, in seconds, in the heating apparatus of the yarns to be set is such that the setting effect SE is equal to or greater than 22.5 where $$SE = a_5 \bullet RT \bullet exp(0.03 \bullet (T - 100) \bullet a_6)$$

where $a_5 = 1 \bullet (1/sec)$, $a_6 = 1 \bullet (1/°C.)$ and T is the temperature of the heat transfer gas in °C.

16. Apparatus for heating, to a desired elevated temperature, yarns having an outside surface, said yarns moving contactlessly in a transport direction into a yarn inlet, comprising a preheating means for heating of heat transfer gas, a duct having a length and surrounding the moving yarn in the form of a tube drilled with a plurality of holes enabling passage of the heat transfer gas, said holes being arranged in the yarn transport direction, at least one feed line for the preheated heat transfer gas having at least one outlet into a distributor chamber from where the preheated heat transfer gas flows into the duct, the holes in the tube being such that the heat transfer gas can impinge radially onto the outside surface of the yarn moving contactlessly in the duct and wherein a preheated heat transfer gas impingement zone being of a length such that continuous removal of a surrounding boundary layer of gas around the yarn by the impinging heat transfer gas ensures that the yarn comes into direct contact with the heat transfer gas.

17. Apparatus as claimed in claim 16, wherein the plurality of holes in the tube is distributed over the length of the duct.

18. Apparatus as claimed in claim 16, wherein the distributor chamber is equipped with at least a pressure temperature sensor coupled to the preheating means.

19. Apparatus as claimed in claim 16, wherein the tube is provided over a centrally located length of about $\frac{1}{4}$ to $\frac{1}{2}$ a length of the tube with small openings from which the heat transfer gas is blown perpendicularly onto the yarn.

20. Apparatus as claimed in claim 16, wherein the preheating means is a heating spiral.

21. Apparatus as claimed in claim 16, surrounded by insulation.

22. Apparatus as claimed in claim 16, wherein a suction means for the heat transfer gas emerging from the yarn duct is provided at least at the yarn inlet or the yarn outlet of the yarn duct.

23. Apparatus as claimed in claim 22, wherein means are provided whereby the heat transfer gas aspirated away by the suction means is recirculated to the preheating means for the heat transfer gas.

* * * * *

UNITED STATES PATENT AND TRADEMARK OFFICE

CERTIFICATE OF CORRECTION

PATENT NO. : 5,390,400
DATED : February 21, 1995
INVENTOR(S) : Ingolf Jacob, et. al.

It is certified that error appears in the above-indentified patent and that said Letters Patent is hereby corrected as shown below:

Title page, item [57],

IN THE ABSTRACT: Line 3, change "has" to -- gas --.

Column 1, line 28, change "rouse" to -- to use --.

Column 5, line 61, after "the" insert -- heat transfer gas in the --; and line 62, after "thus" delete "heat transfer gas in the".

Column 10, line 14, change "$m^3m/h$" to -- $m_3/h$ --; and in the chart of Examples 1-6, under Filament (left hand column), shrinkage for Example 4, change "4.0" to -- 4.8 - and after Loop tenacity, change "(cn/tex)" to -- (cN/tex) --.

Column 11, in the chart of Examples 1-6, Core yarn after dyeing: (left hand column) Loop tenacity, change "cn/tex)" to -- (cN/tex) --; and in Examples 7 to 12, line 43, change "HIMLS" to -- HMLS --.

Column 12, in examples 7-12, Folded Yarn after Dyeing, after "Loop tenacity" insert -- (cN/tex) --.

Column 15, line 5 (claim 7, line 18), before "transfer" insert -- heat -

Column 16, line 39 (claim 15, line 28), change "lops" to -- loops --.

UNITED STATES PATENT AND TRADEMARK OFFICE

CERTIFICATE OF CORRECTION

PATENT NO. : 5,390,400
DATED : February 21, 1995
INVENTOR(S) : Ingolf Jacob, et. al.

It is certified that error appears in the above-indentified patent and that said Letters Patent is hereby corrected as shown below:

Column 17, line 6 (claim 18, line 2), after "pressure" insert -- or --.

Signed and Sealed this

Ninth Day of May, 1995

*Attest:*

Bruce Lehman

BRUCE LEHMAN

*Attesting Officer*

*Commissioner of Patents and Trademarks*